US009500017B2

(12) United States Patent
Sugiura

(10) Patent No.: US 9,500,017 B2
(45) Date of Patent: Nov. 22, 2016

(54) OPENING AND CLOSING DEVICE

(71) Applicant: SUGATSUNE KOGYO CO., LTD., Chiyoda-ku, Tokyo (JP)

(72) Inventor: Mitsuru Sugiura, Tokyo (JP)

(73) Assignee: SUGATSUNE KOGYO CO., LTD., Chiyoda-ku (JP)

( * ) Notice: Subject to any disclaimer, the term of this patent is extended or adjusted under 35 U.S.C. 154(b) by 0 days.

(21) Appl. No.: 14/772,759

(22) PCT Filed: Feb. 26, 2014

(86) PCT No.: PCT/JP2014/054615

§ 371 (c)(1),
(2) Date: Jan. 4, 2016

(87) PCT Pub. No.: WO2014/136625

PCT Pub. Date: Sep. 12, 2014

(65) Prior Publication Data

US 2016/0108656 A1 Apr. 21, 2016

(30) Foreign Application Priority Data

Mar. 4, 2013 (JP) ..... 2013-041937

(51) Int. Cl.
*E05F 3/18* (2006.01)
*E05F 1/10* (2006.01)
(Continued)

(52) U.S. Cl.
CPC ..... *E05F 3/18* (2013.01); *E05F 1/1008* (2013.01); *E05F 1/1016* (2013.01); *E05F 5/027* (2013.01); *E05F 5/08* (2013.01)

(58) Field of Classification Search
CPC ..... E05F 3/18; E05F 5/08; E05F 1/1008; E05F 5/027; E05F 1/1016
USPC ..... 49/324, 339, 346
See application file for complete search history.

(56) References Cited

U.S. PATENT DOCUMENTS 529,101 A * 11/1894 Bauer ..... 16/80
2,651,074 A * 9/1953 Slopa et al. ..... 16/80
2,946,081 A * 7/1960 Juergens ..... 16/80
(Continued)

FOREIGN PATENT DOCUMENTS

JP S62-2137988 U 8/1987
JP 2000-250529 A 9/2000
(Continued)

OTHER PUBLICATIONS

WIPO, Japanese International Search Authority, International Search Report mailed May 27, 2014 in International Patent Application No. PCT/JP2014/054615 (with English translation), 4 pages.

*Primary Examiner* — Jerry Redman
(74) *Attorney, Agent, or Firm* — Masuvalley & Partners

(57) ABSTRACT

The inner surface of one side section of a frame has the base-end section of a rotation arm of a rotation-biasing element that is rotatable. A roller is provided on the tip-end section of the rotation arm. The roller is pressed against and contacts the rear surface of a door as a result of the biasing by the rotation-biasing element. The rear surface of the door is equipped with a damper element. The damper element has a contact member for pressing against and contacting the roller when the door is in the closed position or in a prescribed intermediate position. The contact member minimizes the speed at which the roller moves forward.

5 Claims, 11 Drawing Sheets

(51) Int. Cl.
*E05F 5/02* (2006.01)
*E05F 5/08* (2006.01)

(56) References Cited

U.S. PATENT DOCUMENTS

| | | | | | |
|---|---|---|---|---|---|
| 2,958,089 | A | * | 11/1960 | Roehm et al. | 16/49 |
| 3,164,404 | A | * | 1/1965 | Arnold | 292/273 |
| 3,683,450 | A | * | 8/1972 | Morrison et al. | 16/49 |
| 4,104,761 | A | | 8/1978 | Lyons | |
| 4,348,835 | A | * | 9/1982 | Jones et al. | 49/139 |
| 4,365,442 | A | * | 12/1982 | Speer | 49/346 |
| 4,660,324 | A | * | 4/1987 | Nyenbrink | 49/340 |
| 4,979,261 | A | * | 12/1990 | Lasier et al. | 16/62 |
| 5,392,562 | A | * | 2/1995 | Carambula | 49/346 |
| 5,450,651 | A | * | 9/1995 | Coleman et al. | 16/82 |
| 5,727,348 | A | * | 3/1998 | Arnell et al. | 49/25 |
| 5,829,508 | A | * | 11/1998 | DeBower et al. | 160/371 |
| 6,061,964 | A | * | 5/2000 | Arnell et al. | 49/359 |
| 6,138,412 | A | * | 10/2000 | Rieckmann et al. | 49/349 |
| 7,185,398 | B2 | * | 3/2007 | Kral | 16/72 |
| 8,407,937 | B2 | * | 4/2013 | Houser | 49/139 |
| 2005/0091928 | A1 | * | 5/2005 | Okulov et al. | 49/341 |

FOREIGN PATENT DOCUMENTS

| | | | |
|---|---|---|---|
| JP | 2010-100013 | A | 5/2010 |
| JP | 2011-026817 | A | 2/2011 |

* cited by examiner

OPENING AND CLOSING DEVICE

This application is the U.S. National Phase of, and claims priority to, International Patent Application No. PCT/JP2014/054615, International Filing Date Feb. 26, 2014, entitled Opening/Closing Device (Translated) which claims priority to, and benefit of Japanese Application No. JP2013-041937, filed Mar. 4, 2013, all of which are incorporated herein by reference in their entireties.

TECHNICAL FIELD

The present invention pertains to an opening and closing device provided between a frame and a rotating body to rotate and bias a rotating body in one direction, and on the other hand to minimize the rotating speed of the rotating body when it rotates in one direction and/or another direction.

BACKGROUND TECHNOLOGY

A device disclosed in the following patent document 1 is known as a conventional opening and closing device of this type. The opening and closing device thereof includes a piano frame, a keyboard lid (rotating body) rotatably attached to the piano frame, a device main body attached to the frame, a rotation arm having a base-end section rotatably attached to the device main body, a biasing spring (rotation-biasing means) which rotates and biases the rotation arm, presses the tip-end section thereof against the keyboard lid, and thereby rotates and biases the keyboard lid in the opening direction (first rotating direction), and a rotation damper (damper means) which minimizes the rotating speed of the rotation arm that rotates together with the keyboard lid when the keyboard lid rotates in the closing direction (second rotating direction), and thereby minimizes the rotating speed of the keyboard lid in the closing direction.

The rotation damper includes a casing provided at the device main body so as to be incapable of rotating, a rotating shaft rotatably provided at the casing thereof, and a damper mechanism provided between the rotating shaft and the casing, and the base-end section of the rotation arm is connected to the rotating shaft in a manner incapable of rotation. Accordingly, when the rotation arm rotates, the rotating shaft rotates, and the rotation thereof is suppressed to a low speed by the damper mechanism. As a result, the rotation of the rotation arm is suppressed to a low speed.

PRIOR ART DOCUMENTS

Patent Documents

Patent Document 1: Japanese Unexamined Patent Application Publication No. 2000-250529

SUMMARY OF THE INVENTION

Problem to be Solved by the Invention

With the above-described conventional opening and closing device, because the rotation damper is provided at the base-end section of the rotation arm, the outer diameter of the rotating shaft must be designed as a large diameter in order to obtain a large damper force. However, the rotating shaft is arranged parallel and close to a rotating axis line (first rotating axis line) of the keyboard lid with respect to the piano main body. Therefore, when the outer diameter of the rotating shaft is designed to be large, the rotating shaft and the device main body which supports the rotating shaft must be separated by that amount alone from the first rotating axis line, and thus a problem of the opening and closing device being subjected to design related constraints exists.

Moreover, because the biasing spring and the rotation damper are incorporated together with the device main body, if there is a desire to change the combination of the size of the biasing force of the biasing spring and the size of the damper force of the rotation damper for each type, the number of types of opening and closing devices that become necessary is as many as the demanded combinations, and when the types of opening and closing devices increases, another problem is that the manufacturing and control costs also increase.

Means for Solving the Problems

In order to resolve the above-described problems, the present invention is an opening and closing device provided with a frame, a rotating body having one end rotatably connected to the frame between a first position and a second position centered on a first rotating axis line, a rotation-biasing means which rotates and biases the rotating body in a first rotating direction from the first position towards the second position, and a damper means which suppresses the rotational speed of the rotating body when the rotating body rotates in at least one direction of the first rotating direction and a second rotating direction, which is direction opposite the first rotating direction; wherein, the rotation-biasing means includes a rotation arm having a base-end section rotatably provided at one of either the frame or the rotating body centered on a second rotating axis line parallel to the first rotating axis line, and a rotation and biasing member which rotates and biases the rotation arm, causes a tip-end section of the rotation arm to press against and contact the other of either the frame or the rotating body, and thereby rotates and biases the rotating body in the first rotating direction; and the second rotating axis line is separated and arranged with respect to the first rotating axis line so as to be orthogonal thereto such that when the rotating body rotates in the first rotating direction, the tip-end section of the rotation arm moves in a direction approaching the first rotating axis line, and when the rotating body rotates in the second rotating direction, the tip-end section of the rotation arm moves linearly along the rotating body in a direction of moving away from the first rotating axis line; and the damper means includes a damper body provided at the other of the frame and the rotating body; a movable member provided at the damper body so as to be capable of moving linearly in the same direction as a movement direction of the tip-end section of the rotation arm, and associated with the tip-end section of the rotation arm so as to enable relative movement with respect to the damper body in association with movement of the rotation arm; and a damper mechanism provided between the damper body and the movable member to suppress the movement speed of the movable member to a low speed.

In this case, the movable member is preferably arranged in front of the movement direction of the tip-end section of the rotation arm when the movable member is rotating to the first rotating direction of the rotating body such that when the rotating body rotates in the second rotating direction, the tip-end section of the rotation arm butts against the movable member, and causes the movable member to move.

Furthermore, the movable member is preferably arranged to move away from the tip-end section of the rotation arm when the rotating body is positioned at the first position and to the front of the tip-end section in the moving direction when the rotation arm rotates in the first rotation and biasing direction such that the tip-end section of the rotation arm butts against the movable member when the rotating body rotates in the second rotating direction by only a prescribed angle from the second position towards the first position.

Also preferably, the movable member is formed in a rod shape, the longitudinal direction thereof is arranged in the same direction as the moving direction of the tip-end section of the rotation arm, and the tip-end section of the rotation arm butts against one end of the movable member in the longitudinal direction.

The tip-end section of the rotation arm, the movable member, and the damper body are also preferably arranged so as to be aligned in nearly a row in the movement direction of the tip-end section of the rotation arm.

Effect of the Invention

According to the present invention having the above-described characteristic configuration, the damper means is provided separately from the rotation-biasing means. Accordingly, a rotation damper for suppressing the rotation of the rotation arm to a low speed is not necessary, and the need to provide a large diameter rotating shaft is eliminated. Therefore, the rotating shaft of the rotation arm can be arranged close to a door. Of course the rotating shaft of the rotation arm can also be arranged away from the door. Thus, design related constraints that occur when an opening and closing device is provided between a frame and a door can be minimized.

Moreover, because the rotation-biasing means and the damper means are provided separately, rotation-biasing means having different rotational biasing forces and damper means having different damper forces can be freely combined. Accordingly, compared to a conventional opening and closing device for which the rotation-biasing means and the damper means are included in an integrated form, the types of opening and closing devices that should be manufactured can be significantly reduced, and the manufacturing costs and control costs can be reduced by that amount.

MODE FOR CARRYING OUT THE INVENTION

Figure 1:
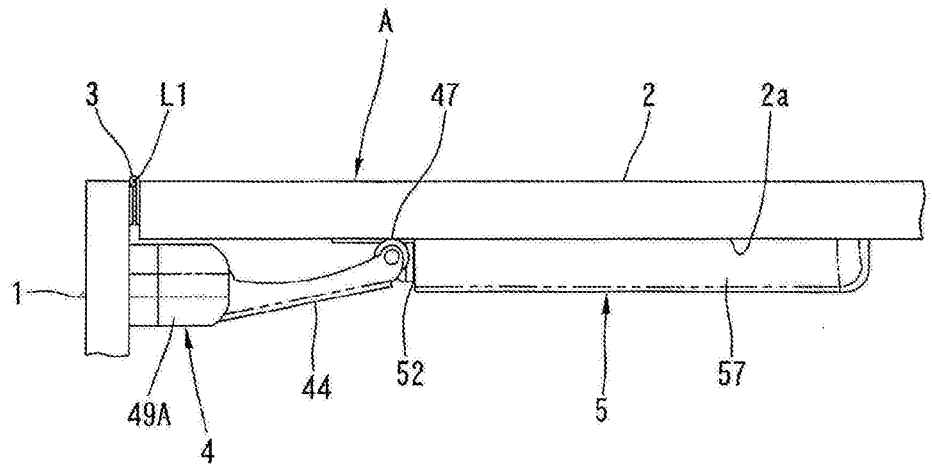
FIG. 1 is an elevation view showing the key parts of one embodiment of the present invention with the door positioned at the closed position.

Preferred embodiments for carrying out the present invention are described below with reference to the drawings.

FIGS. 1 to 12 show a first embodiment of the present invention. As shown in FIGS. 1 to 5, an opening and closing device A according to the present invention has a frame 1 and a door (rotating body) 2. The frame 1 is formed in a box shape with the top surface part opened. On the other hand, the door 2 is used to open and close the opened part of the top surface of the frame 1, and a front end part thereof is provided at a top end part of the inner surface of a front side part of the frame 1 so as to be rotatable in the up and down direction via a hinge 3. The door 2 is capable of rotating between a closed positioned (first position) shown in FIG. 1 with the top surface open part of the frame 1 closed and an opened position (second position) shown in FIG. 3 with the top surface open part of frame 1 opened. The rotational center line of the hinge 3 is arranged horizontally toward the right and left directions, and is the first rotating axis line L1. Note that the front surface part of the frame 1 may also be opened. In this case, the door 2 is provided so as to be capable of rotating in the up and down directions centered on a horizontal first rotating axis line at the front end part of the top inner surface of the frame.

A rotation-biasing means 4 is provided at the frame 1, and a damper means 5 is provided at the door 2. The rotation-biasing means 4 rotates and biases the door 2 in an opening direction (first rotating direction) from the closed position to the opened position. If the door 2 is rotated in a closing direction (second rotating direction) from the opened position to the closed position, the damper means 5 suppresses the rotation speed of the door 2 in the closing direction to a low speed when the door 2 is rotated from an intermediate position shown in FIG. 2 to the closed position.

The rotation-biasing means 4 has a base part 41. The base part 41 is positionally fixed and provided at an inner surface of a same side part as the side part of the frame 1 at which the hinge 3 is provided. The base part 41 is arranged further downward than the door 2. Moreover, the base part 41 is arranged close to the top surface of the frame 1 in a range that does not interfere with the door 2.

Two shafts 42, 43 are provided at the base part 41. The shafts 42, 43 are arranged so as to be mutually parallel and parallel with the first rotating axis line L1. A center line of the shaft 42 is a second rotating axis line L2. The second rotating axis line L2 is arranged away from the first rotating axis line L1 in a direction that is orthogonal thereto. More specifically, the second rotating axis line L2 is arranged at an interior side of the frame 1 with respect to the first rotating axis line L1 (the downward side in FIGS. 1 to 3 and FIG. 5), and away to the other side part (right side on FIGS. 1 to 3 and FIG. 5).

A base-end section of a rotation arm 44 is supported by the shaft 42. Through this, the base-end section of the rotation arm 44 is supported at the base part 41 so as to be rotatable in the up and down directions via the shaft 42. The base-end section of the rotation arm 44 and both the right and left end parts of the base part 41 are respectively covered by cosmetic covers 49A, 49B.

A torsion coil spring (rotation and biasing member) 45 is extrapolated via a sleeve 46 to the shaft 42. One end part of the torsion coil spring 45 butts against the rotation arm 44, and the other end part butts against the shaft 43. Furthermore, the coil spring 45 rotates and biases the rotation arm 44 in the counterclockwise direction (hereinafter, referred to as the rotational biasing direction, and the reverse direction is referred to as the opposite biasing direction) of FIGS. 1 to 3 and FIG. 5 centered on the second rotating axis line L2. In other words, the rotation arm 44 is rotated and biased by the torsion coil spring 45 such that the tip-end section of the rotation arm 44 approaches the door 2.

At the tip-end section of the rotation arm 44, a roller 47 is provided so as to be rotatable via a shaft 48 which is parallel to the shaft 42. The roller 47 is pressed against a back surface 2*a* of the door 2 by the biasing force of the torsion coil spring 45. As a result, the door 2 is rotated and biased in the opening direction by the torsion coil spring 45 via the rotation arm 44 and the roller 47. However, when the door 2 is positioned between the closed position and a prescribed independent position that is between the opened position and the intermediate position, the rotational biasing force of the torsion coil spring 45 is smaller than the rotational moment due to the weight of the door 2 itself. Accordingly, when the door 2 is in a state of being able to rotate freely between the closed position and the independent position, the door 2 rotates to the closed position due to its own weight. Moreover, when the door 2 is in a state of being able to rotate freely between the independent position and the opened position, the door 2 is rotated to the opened position by the torsion coil spring 45 and is maintained at the opened position.

Because the second rotating axis line L2 is arranged away from the first rotating axis line L1 in a direction that is orthogonal thereto as described above, when the door 2 rotates centered on the first rotating axis line L1, the tip-end section of the rotation arm 44 moves along the back surface 2*a* of the door 2 in a direction of approaching or moving away from the first rotating axis line L1. As a result, the roller 47 rolls on the back surface 2*a*. When the door 2 is rotated in the opening direction, the roller 47 moves so as to approach the first rotating axis line L1 (hereinafter, movement at this time is referred to as backward movement), and when the door 2 rotates in the closing direction, the roller 47 moves so as to move away from the first rotating axis line L1 (hereinafter, movement at this time is referred to as advancing movement).

The damper means 5 is provided at the back surface 2*a* of the door 2. The damper means 5 is arranged so as to be positioned ahead of the advancing movement direction of the roller 47 (tip-end section of the rotation arm 44).

As shown particularly in FIG. 4 and FIGS. 9 to 12, the damper means 5 has a base part 51. The base part 51 is formed in a rectangular plate shape from a planar view, and is fixed to the back surface 2*a*. The longitudinal direction of the base part 51 is arranged towards the movement direction of the roller 47 such that it is in front of the roller 47 in the advancing movement direction. Moreover, as is clear from FIG. 4, when viewed from a planar perspective, the center of the base part 51 in the width direction is arranged so as to nearly match the center of the axial line direction of the roller 47.

An abutting member 52 is provided at the tip end of the base part 51 on the roller 47 side (hereinafter, the tip end is referred to as the tip-end section, and the end part on the opposite side is referred to as the rear end part) such that the abutting member 52 is capable of moving in the front and back directions of the base part 51 (same direction as the movement direction of the roller 47). When the abutting member 52 moves in a direction of approaching the roller 47 and reaches an extension position shown in FIG. 3, movement in the same direction beyond that position is inhibited by a stopper mechanism (not illustrated) provided between the base part 51 and the abutting member 52. The abutting member 52 is capable of somewhat exceeding a retraction position shown in FIG. 1 and moving in a direction away from the roller 47, but as long as this opening and closing device A is used in operations to open and close the door 2, it will not exceed the retraction position and move in the same direction.

Figure 2:
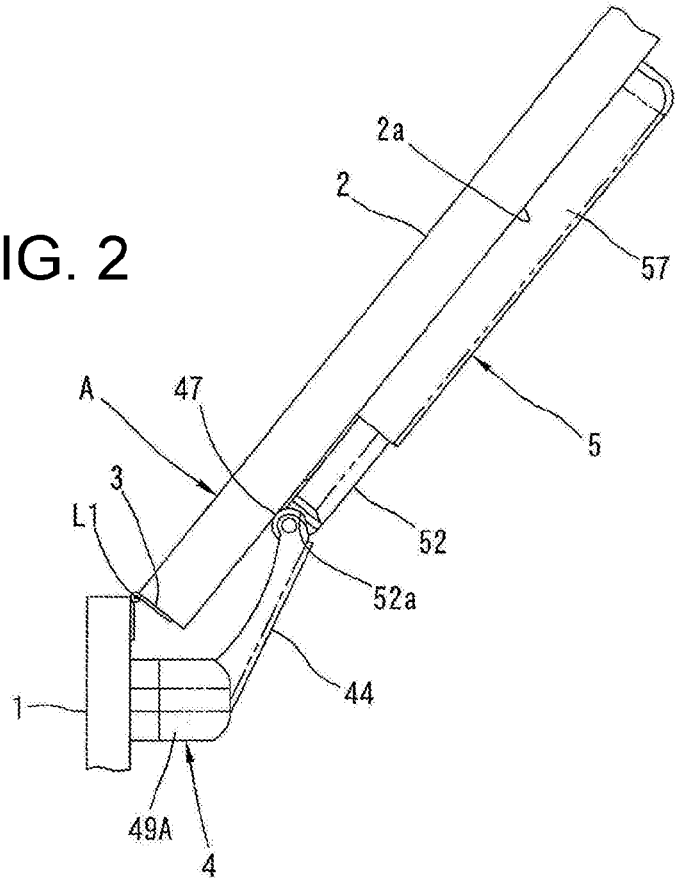
FIG. 2 is an elevation view showing the key parts of the same embodiment with the door positioned at a position between the closed position and the opened position.
Figure 3:
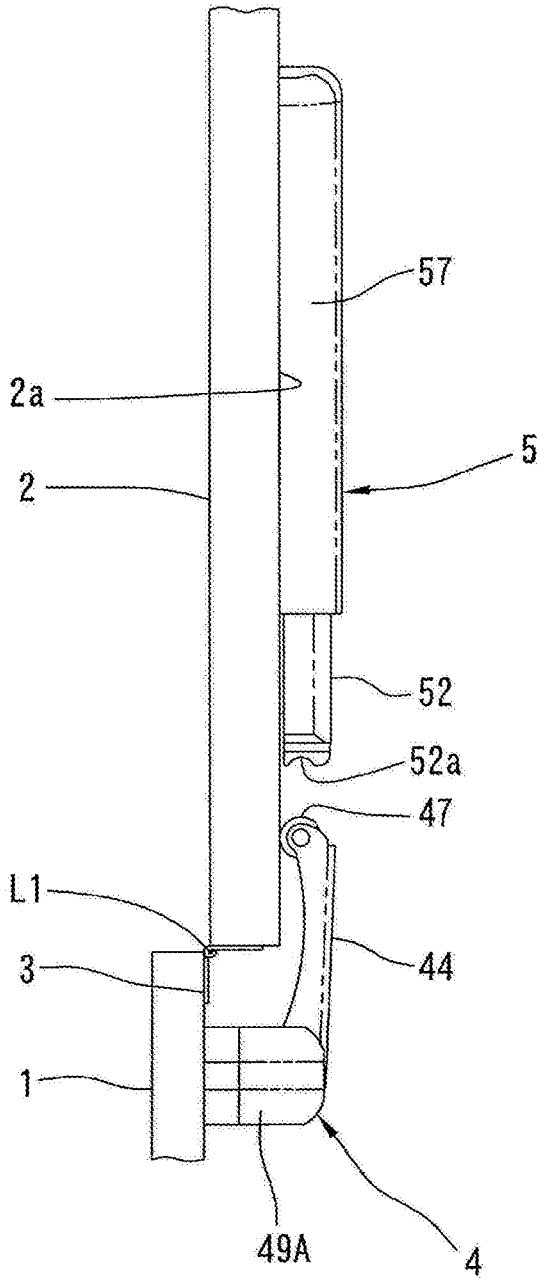
FIG. 3 is an elevation view showing the key parts of the same embodiment with the door positioned at the opened position.
Figure 4:
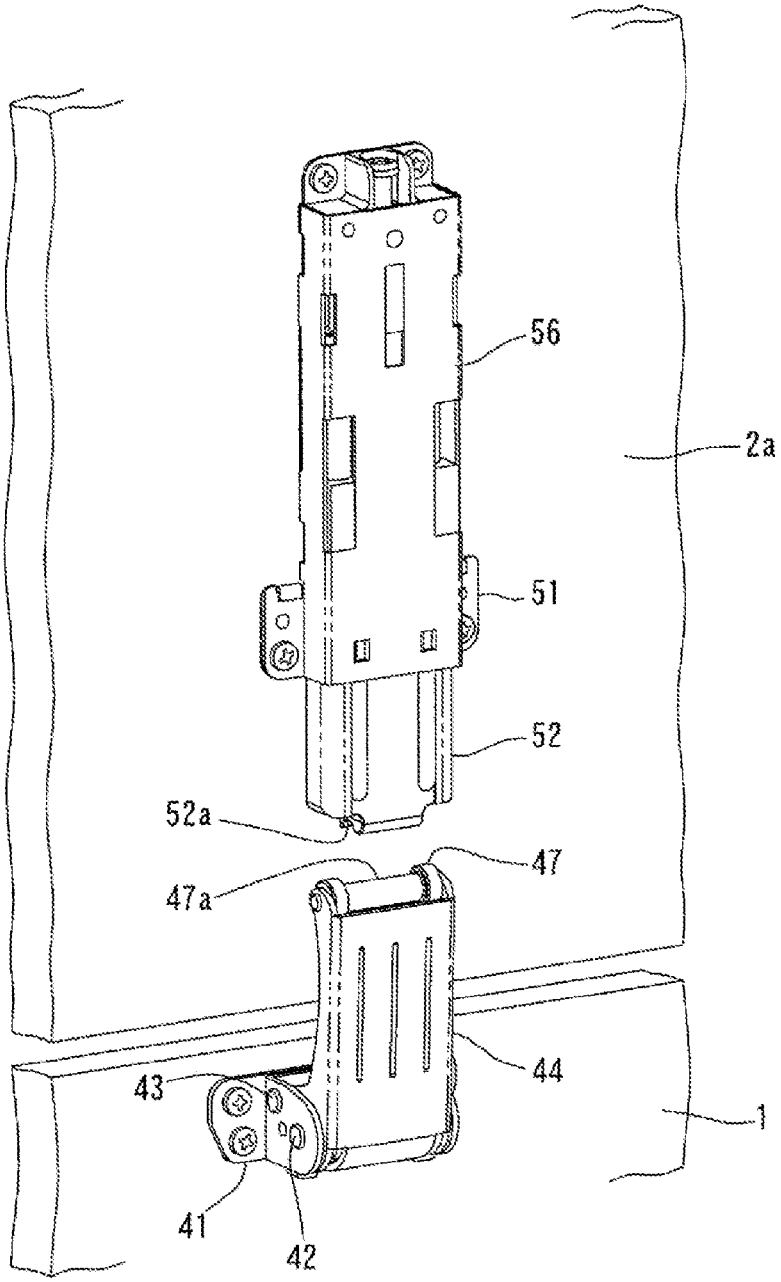
FIG. 4 is a perspective view showing the key parts of the same embodiment with the door positioned at the opened position.
Figure 5:
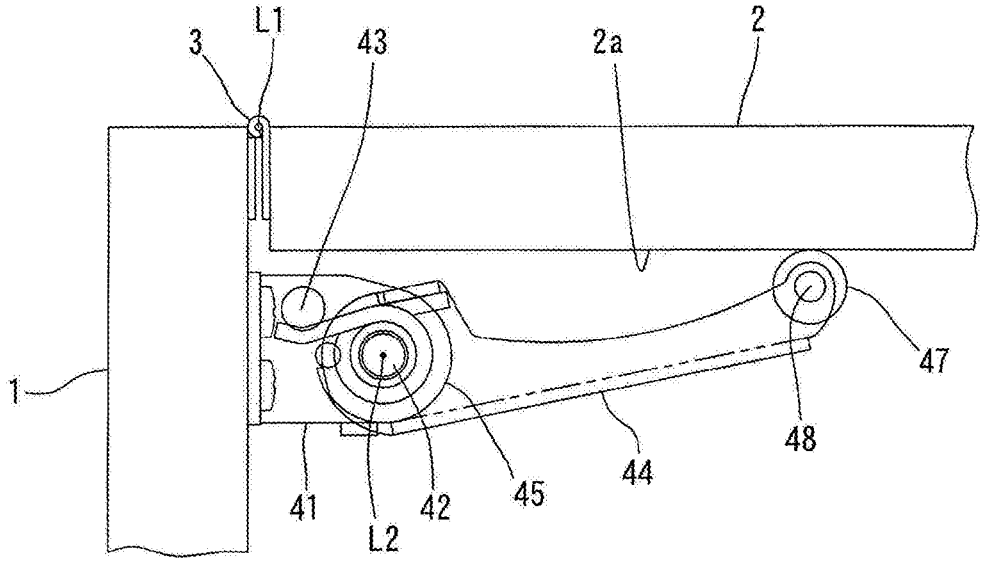
FIG. 5 is a perspective view showing the rotation-biasing means used in the same embodiment.
Figure 6:
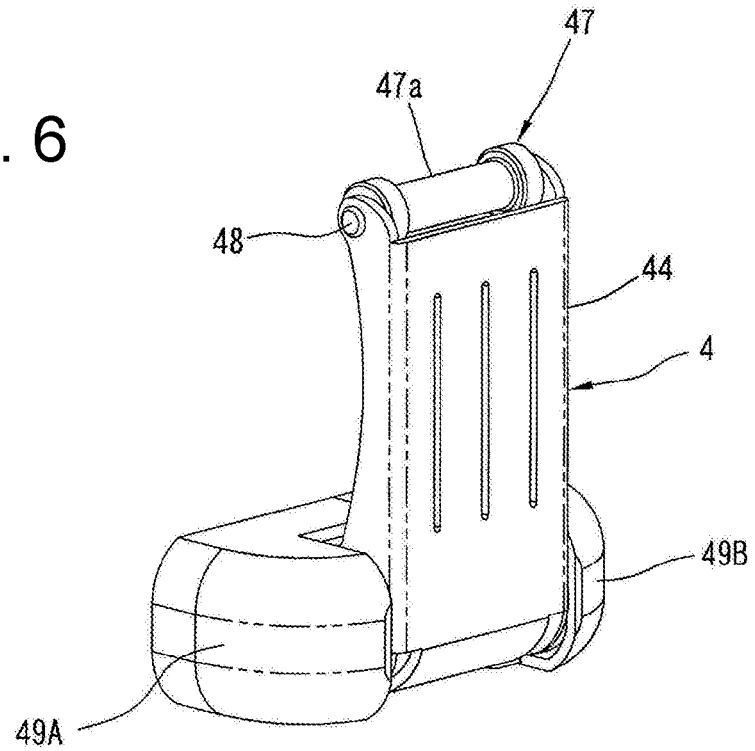
FIG. 6 is a perspective view showing the same rotation-biasing means.
Figure 7:
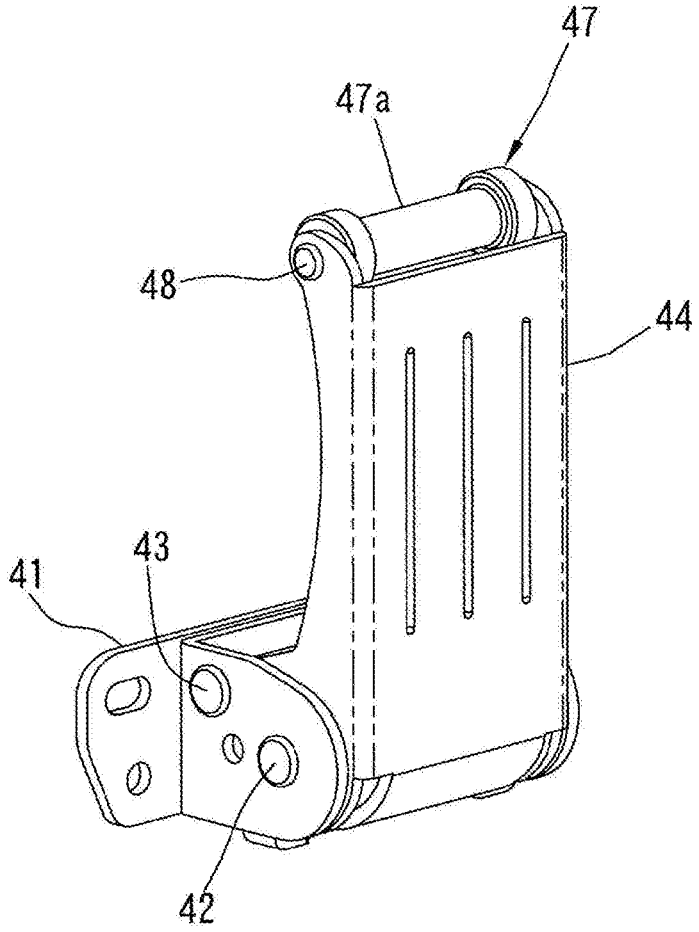
FIG. 7 is a perspective view showing the rotation-biasing means without the cover.
Figure 8:
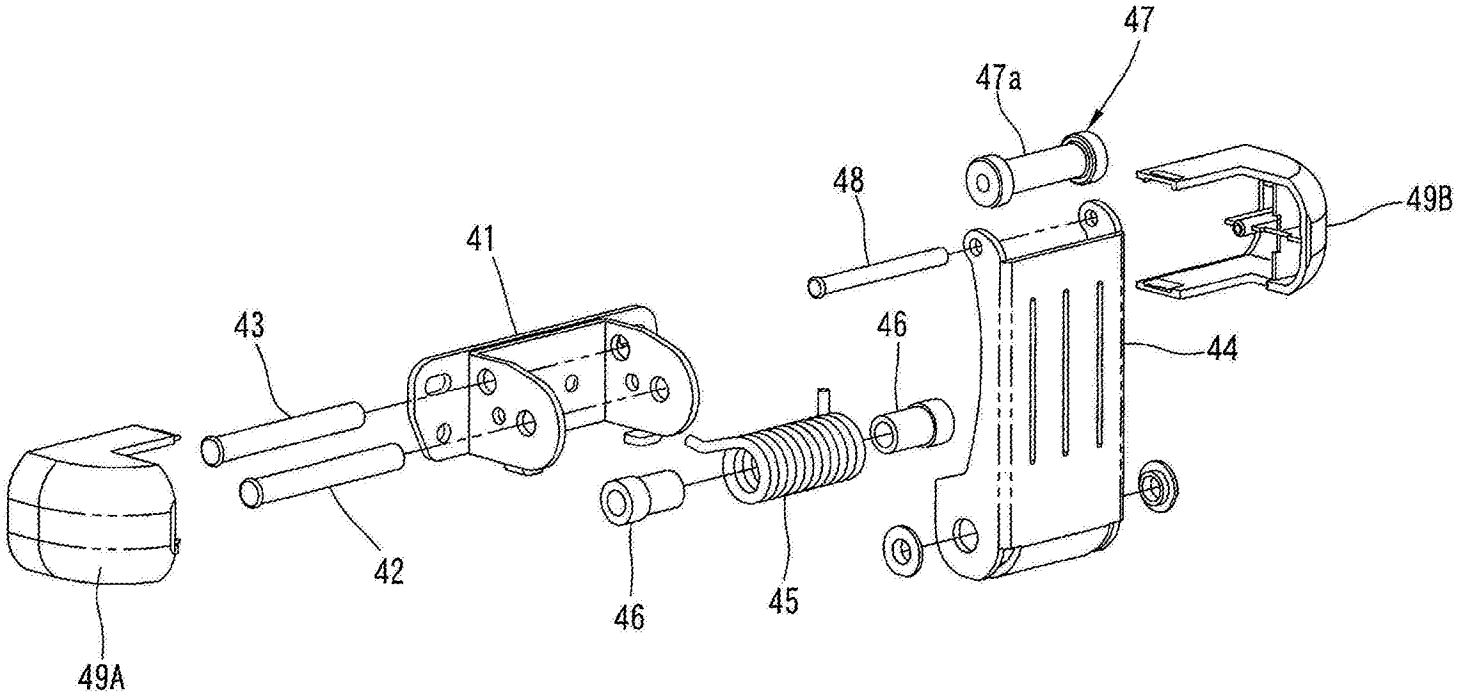
FIG. 8 is an exploded perspective view of the same rotation-biasing means.
Figure 9:
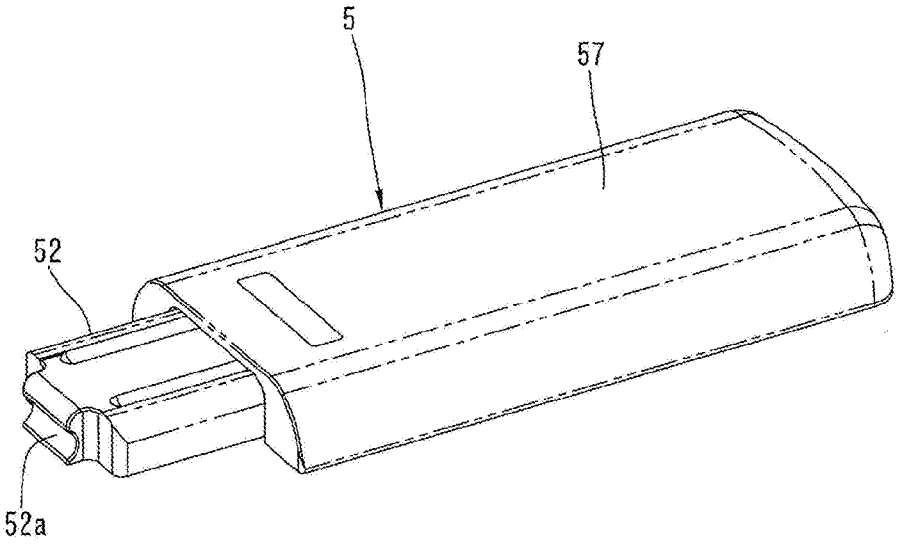
FIG. 9 is a perspective view showing a damper means used in the same embodiment.
Figure 10:
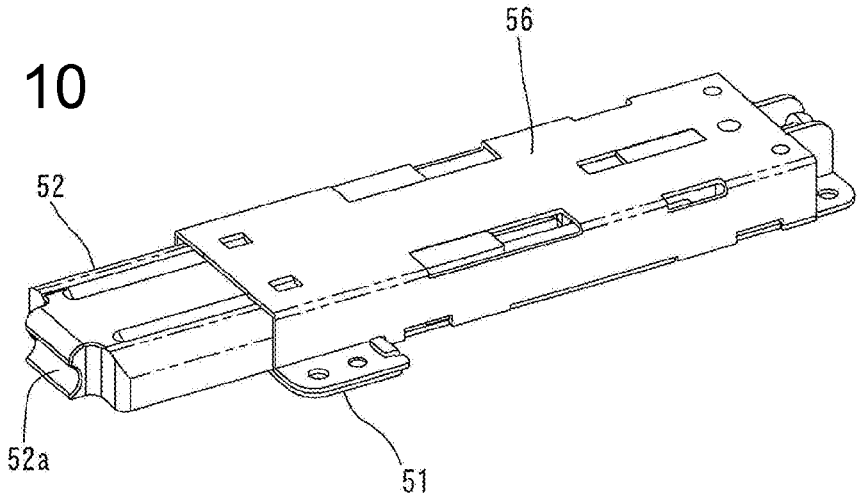
FIG. 10 is a perspective view showing the same damper means without the cover.

An abutting recess part 52*a* is formed at the tip end face of the abutting member 52. A basal surface of the abutting recess part 52*a* is configured of a circular arc shaped surface. The circular arc shaped surface has a radius of curvature that is equal to the radius of a shaft part 47*a* at a center part of the roller 47. As shown in FIG. 2, the abutting recess part 52*a* is positioned such that when the abutting member 52 is positioned at the extension position and the door 2 rotates from the closed position to the intermediate position, the shaft part 47*a* of the roller 47 butts against the basal surface of the abutting recess part 52*a*. Accordingly, when the door 2 rotates in the closing direction and exceeds the intermediate position, the abutting member 52 is moved to the rear of the base part 51 by the roller 47. When the door 2 rotates to the closed position, the abutting member 52 reaches the retraction position. In this manner, the abutting member 52 is moved forward by the roller 47 (tip-end section of the rotation arm 44), but as long as the abutting member 52 is caused to move by the roller 47, the movement direction of the abutting member 52 does not necessarily have to be the same direction as the movement direction of the roller 47, and it may be at a somewhat slanted direction with respect to the movement direction of the roller 47. In other words, in the present invention, the "same direction" also includes this type of slanted direction.

The abutting member 52 is biased by a biasing mechanism 53 to the front side of the base part 51. The biasing mechanism 53 has an adjustment member 53*a* provided at the base part 51 so as to be capable of moving in the front and back direction. The adjustment member 53*a* is arranged at a center part of the base part 51 in the width direction. A compression coil spring 53*b* is provided between the adjustment member 53*a* and the abutting member 52. The abutting member 52 is biased forward by this compression coil spring 53*b*. Accordingly, the abutting member 52 is caused to move forward by the biasing force of the compression coil spring 53*b*, and is caused to move rearward in opposition to the biasing force of the compression coil spring 53*b*.

The adjustment member 53*a* is positionally adjusted in the front and back direction of the base part 51 by a position adjustment mechanism having a bolt 53*c* and a nut 53*d*. When the adjustment member 53*a* is caused to move forward, the biasing force of the compression coil spring 53*b* with respect to the abutting member 52 becomes stronger.

Conversely, when the adjustment member 53*a* is caused to move rearward, the biasing force of the compression coil spring 53*b* with respect to the abutting member 52 becomes weaker.

Figure 11:
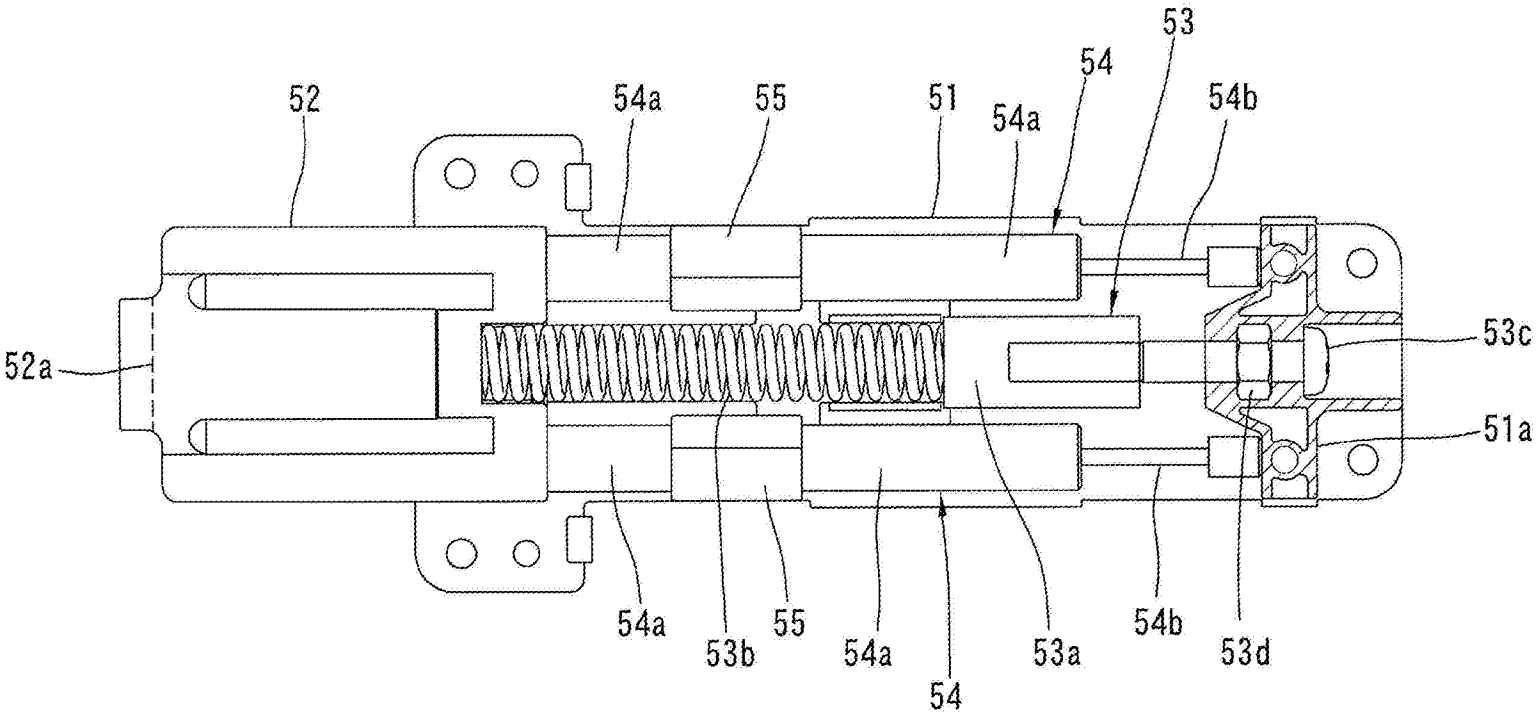
FIG. 11 is a plan view showing the same damper means as shown in FIG. 9, without the cover and lid body.
Figure 12:
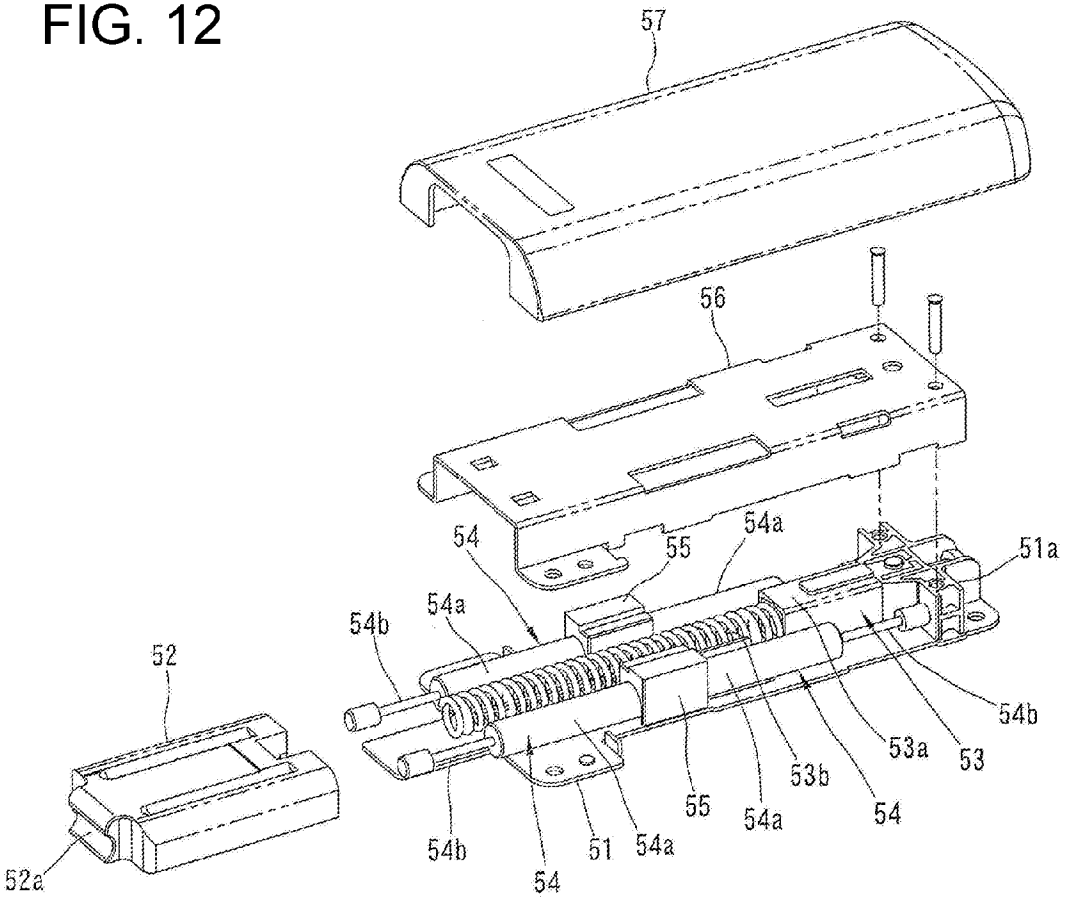
FIG. 12 is an exploded perspective view showing the same damper means.

As shown in FIG. 11, two linear dampers 54 which make a single set are respectively provided at both sides of the base part 51 in the width direction. The linear damper 54 has a damper body 54*a* which forms a cylindrical shape with a bottom, and a rod-shaped rod (movable member) 54*b* which is inserted in the damper body 54*a* such that one end part in the longitudinal direction is capable of moving in the longitudinal direction of the damper body 54*a*, and the longitudinal direction thereof (longitudinal direction of the damper body 54*a* and the rod 54*b*) is arranged in the front and back direction of the base part 51 (movement direction of the roller 47). A damper mechanism (not illustrated) which suppresses the movement speed of the rod 54*b* to a slow speed is provided between the damper body 54*a* and the rod 54*b*.

With the set of linear dampers 54, 54, the end parts of the respective damper bodies 54*a*, 54*a* on the basal part side are mutually interlocked by an interlocking member 55. Through this, the set of linear dampers 54, 54 is configured such that the dampers thereof move in an integrated manner in the front and back directions. The rod 54*b* of the linear damper 54 of the front side butts against the abutting member 52. The rod 54*b* of the linear damper 54 of the back side butts against a protrusion 51*a* provided at the rear end part of the base part 51.

Accordingly, when the abutting member 52 is caused to move toward the rear of the base part 51 by the roller 47, one end part of the rod 54*b* of each linear damper 54 is caused to move so as to enter the inside of the damper body 54*a*. At this time, the movement speed of the rod 54*b* is suppressed to a low speed, and therefore, the movement speed of the roller 47 is also suppressed to a low speed. As a result, the speed of rotation of the rotation arm 44 in the opposite biasing direction is suppressed to a low speed, and therefore the speed of rotation of the door 2 in the closing direction is suppressed to a low speed. On the other hand, when the abutting member 52 moves forward, movement of the abutting member 52 in the forward direction is not regulated by the rod 54*b*, and the abutting member 52 is capable of moving freely, or in other words, of moving in a state separated from the rod 54*b*. Accordingly, the abutting member 52 can move forward at a high speed. As a result, the rotation arm 44 can rotate at a high speed in the biasing direction, and the door 2 can rotate at a high speed in the opening direction.

When the abutting member 52 moves to the anterior of the base part 51, the rod 54*b* is caused by a return spring (not illustrated) provided inside the damper body 54*a* to move at a low speed in a direction of coming out of the damper body 54*a*. Accordingly, when the abutting member 52 moves forward at a low speed, the rod 54*b* moves together with the abutting member 52, but when the abutting member 52 moves at a high speed, the rod 54*b* moves at a lower speed than the abutting member 52. As a result, after the abutting member 52 moves to the extension position and stops, the rod 54*b* of the linear damper 54 of the front side butts against the abutting member 52 and stops. The rod 54*b* of the linear damper 54 of the rear side maintains a state of butting against the protrusion 51*a*.

Note that regarding the set of linear dampers 54, 54, the rods 54*b*, 54*b* themselves may be interlocked by the interlocking member 55, and a damper body 54*a* of a single linear damper 54 may butt against the abutting member 52, and the damper body 54*a* of the other linear damper 54 may butt against the protrusion 51*a*. Moreover the linear dampers 54 may be respectively arranged at both sides of the base part 51 in the width direction with one on each side, or a single linear damper 54 may be aligned with the compression coil spring 53*b* and arranged at a center part in the width direction of the base part 51. When the linear damper 54 is arranged in this manner, one of either the damper body 54*a* or the rod 54*b* is butted against the abutting member 52, and the other is butted against the protrusion 51*a*.

The base part 51, the rear end part of the abutting member 52, the biasing mechanism 53 and the linear damper 54 are covered by a cover member 56. Through this, separation of the rear end part of the abutting member 52, the biasing mechanism 53 and the linear damper 54 from the base part 51 is inhibited. Moreover, the cover member 56 is covered by a cosmetic cover 57, and through this, the aesthetic beauty of the damper means 5 is improved.

With an opening and closing device A of the above-described configuration, when the door 2 is positioned at the closed position, the abutting member 52 is caused by the roller 47 to move to the retraction position. Accordingly, the abutting member 52 is pressed against the roller 47 by the compression coil spring 53*b*. When the door 2 is rotated in the opening direction from the closed position, the roller 47 moves backwards. Along with that movement, the abutting member 52 moves anterior to the base part 51. When the door 2 reaches the intermediate position, the abutting member 52 stops at the extension position. When the door 2 is later rotated further in the opening direction, the roller 47 moves away from the abutting member 52. When the door 2 exceeds the independent position, the rotation-biasing means 4 causes the door 2 to rotate to the opened position, and the door 2 is then maintained in the opened position.

When the door 2 is rotated in the closing direction from the opened position, the roller 47 advances. At this time, the roller 47 is away from the abutting member 52 and can move freely. Accordingly, the door 2 can rotate at a high speed in the closing direction to the intermediate position. When the door 2 reaches the intermediate position, the roller 47 butts against the abutting member 52. As a result, the advancing movement speed of the roller 47 is suppressed to a low speed by the damper means 5 until the door 2 reaches the closed position from the intermediate position, and therefore the speed of rotation of the rotation arm 44 in the opposite biasing direction, and the speed of rotation of the door 2 in the closing direction are suppressed to a low speed. The door 2 stops at the closed position.

With the above-described opening and closing device A, the damper means 5 is provided separately from the rotation-biasing means 4. Accordingly, a rotation damper for suppressing the speed of rotation of the rotation arm 44 to a low speed is not necessary, and there is no need to provide a large diameter rotating shaft. Therefore, the shaft 42, which is the rotating shaft of the base-end section of the rotation arm 44, can be arranged close to the door 2. Of course, the shaft 42 can also be arranged away from the door 2. Accordingly, the design related constraints that occur when providing the opening and closing device A between the frame 1 and the door 2 can be minimized.

Moreover, because the rotation-biasing means 4 and the damper means 5 are provided separately, rotation-biasing means 4 having different rotation biasing forces, and damper means 5 having different damper forces can be freely combined. Accordingly, compared to a conventional opening and closing device for which the rotation-biasing means and damper means are incorporated in an integrated manner, the types of opening and closing devices that must be manufactured can be significantly reduced, and the manufacturing costs and control costs can be reduced by that amount.

Figure 13:
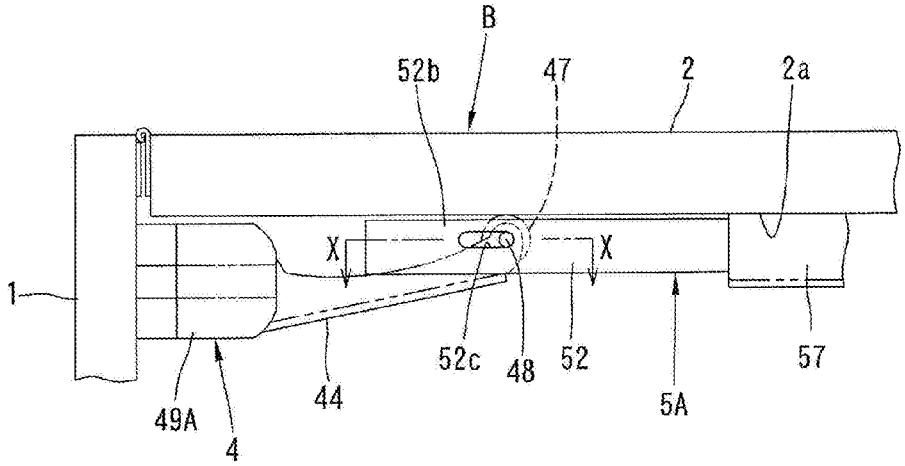
FIG. 13 is the same drawing as FIG. 1 showing a second embodiment of the present invention.
Figure 14:
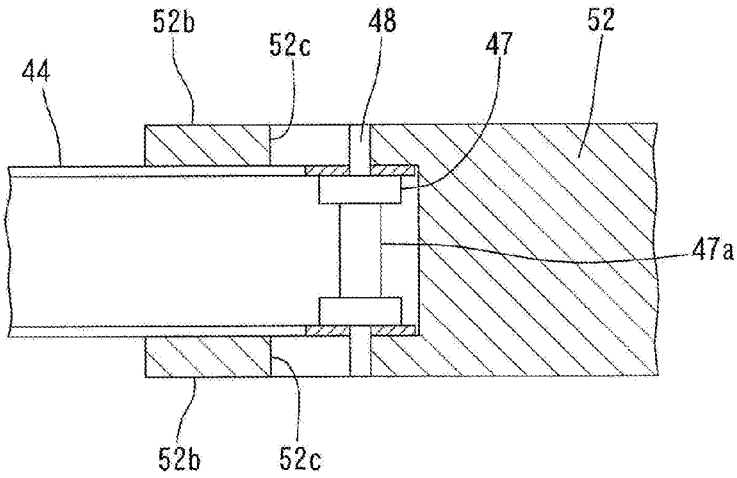
FIG. 14 is an enlarged cross-sectional view along the line X-X of FIG. 13.
Figure 15:
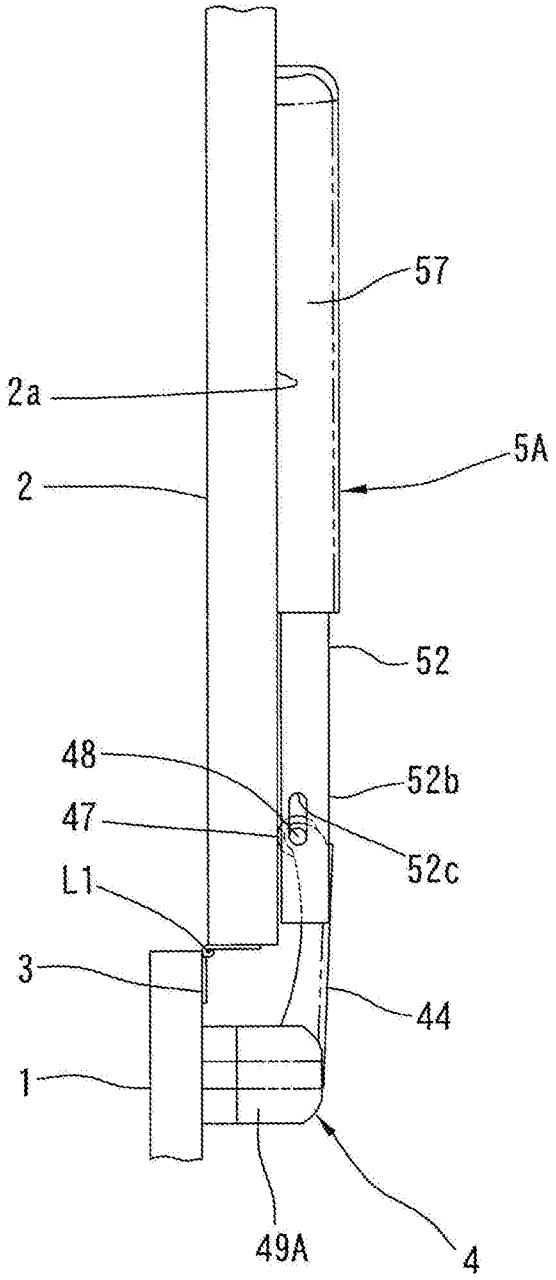
FIG. 15 is the same drawing as FIG. 3 showing the second embodiment.

FIG. 13 to FIG. 15 show a second embodiment of the present invention. With an opening and closing device B of this embodiment, a damper means 5A is used in place of the damper means 5. The damper means 5A is a type of damper which exhibits damper action even if the abutting member 52 moves to either the right or left direction of FIG. 13. With the damper means 5A, protrusions 52*b*, 52*b*, which protrude towards the roller 47 side are formed at both sides of the tip end face of the abutting member 52. A long hole 52*c* extending in the projection direction of the protrusions 52*b* is formed at each of the protrusions 52*b*. The shaft 48 is inserted into the long holes 52*c*, 52*c* of each of the protrusions 52*b*, 52*b* such that the shaft 48 is capable of moving in the longitudinal direction of the long holes 52*c*. The long holes 52*c* are arranged so as to satisfy the following conditions. Namely, when the door 2 is positioned at a prescribed first intermediate position between the closed position and the opened position, the shaft 48 shall butt against the rear end part of the long hole 52*c* (front end part in the advancing direction of the roller 47). Moreover, when the door 2 rotates to the closed position, the abutting member 52 shall be caused to move to the retraction position by the shaft 48. When the door 2 is positioned between the opened position and a prescribed second intermediate position between the first intermediate position and the opened position, the shaft 48 shall butt against the front end part of the long hole 52*c*. Moreover, when the door 2 rotates to the opened position, the abutting member 52 shall be caused to move to the advancement position by the shaft 48.

Therefore, according to the opening and closing device B of the present embodiment, both when the door 2 rotates from the first intermediate position to the closed position, and when the door 2 rotates from the second intermediate position to the opened position, the speed of rotation of the door 2 can be suppressed to a low speed.

In place of the long hole 52*c*, a round hole having an inner diameter that is the same as the outer diameter of the shaft 48 may be provided, and the shaft 48 may be inserted into the hole thereof. In this case, the abutting member 52 always tracks the movement of the roller 47 when moving, and therefore, the rotational speed of the door 2 can be suppressed to a low speed both when the door 2 is positioned at any position between the closed position and the opened position.

Note that the present invention is not limited to the above-described embodiments, and various types of modification examples can be adopted within a scope that does not depart from the gist thereof.

For example, with the above-described embodiments, the frame 1 is formed in a box shape, but the frame 1 does not have to be a box shape. The frame, for example, may be a counter that separates a sales clerk side from a customer side at a convenience store or other store. In this case, a pathway that connects the sales clerk side with the customer side is formed in the counter by cutting through a portion thereof, and a rotating body is provided at the top of the counter facing the pathway thereof. When the counter is positioned in the opened position, the pathway is opened, and when it is positioned in the closed position, the pathway is closed, and a portion of the counter is configured.

Moreover, with the above-described embodiments, the rotation-biasing means 4 is provided at the frame 1, and the damper means 5 is provided as the door 2. However, the rotation-biasing means 4 may be provided at the door 2, and the damper means 5 may be provided at the frame 1. In this case, the roller 47 is caused to press against and contact an inner surface at one side part of the frame 1, and the damper means 5 is provided at an inner surface at one side of the frame 1 positioned ahead of the roller 47 in the advancing movement direction.

Furthermore, with the above-described embodiments, when the door 2 rotates in the closing direction, the damper means 5, 5A are positioned ahead of the direction of movement of the roller 47, but if a sufficiently large gap is present between the opposing surfaces of the door 2 and the rotation arm 44 (in FIG. 1, between the opposing surfaces which are opposing in the vertical direction), the damper means 5, 5A may be positioned at that gap. In this case, the damper means 5, 5A are arranged symmetrical to the above-described embodiments.

Also, with the above-described embodiments, the rod 54*b* of the linear damper 54 is pressed against the roller 47 via the abutting member 52, but the rod 54*b* may also be directly pushed against the roller 47, or the damper body 54*a* may be pushed directly against the roller 47.

REFERENCE SYMBOLS

A: opening and closing device
B: opening and closing device
L1: first rotating axis line
L2: second rotating axis line
1: frame
2: door (rotating body)
4: rotation-biasing means
5: damper means
5A: damper means
44: rotation arm
45: torsion coil spring (rotation and biasing member)
54: linear damper
54*a*: damper body
54*b*: rod (movable member)

What is claimed is:

1. An opening and closing device comprising:

a frame;

a rotating body having one end rotatably connected to the frame between a first position and a second position centered on a first rotating axis line;

a rotation-biasing means which rotates and biases the rotating body in a first rotating direction from the first position towards the second position; and a damper means which suppresses the rotational speed of the rotating body when the rotating body rotates in at least one direction of the first rotating direction and a second rotating direction from the second position towards the first position;

wherein, the rotation-biasing means comprises:

a rotation arm having a base-end section rotatably provided at one of either the frame or the rotating body centered on a second rotating axis line parallel to the first rotating axis line; and a rotation and biasing member which rotates and biases the rotation arm, causes a tip-end section of the rotation arm to press against and contact either the frame or the rotating body, and thereby rotates and biases the rotating body in the first rotating direction; and the second rotating axis line is separated and arranged with respect to the first rotating axis line so as to be orthogonal thereto such that when the rotating body rotates in the first rotating direction, the tip-end section of the rotation arm moves in a direction approaching the first rotating axis line, and when the rotating body rotates in the second rotating direction, the tip-end section of the rotation arm moves linearly along either the frame or the rotating body in a direction of moving away from the first rotating axis line; and the damper means comprises:

a damper body provided at either the frame or the rotating body;

a movable member provided at the damper body so as to be capable of moving linearly in a same direction as a moving direction of the tip-end section of the rotation arm, and associated with the tip-end section of the rotation arm so as to enable relative movement with respect to the damper body in association with movement of the rotation arm; and a damper mechanism provided between the damper body and the movable member to suppress the movement speed of the movable member.

2. The opening and closing device according to claim 1, wherein the movable member is arranged in front of the tip-end section of the rotation arm in the moving direction when the rotating body is rotating in the second rotating direction such that the tip-end section of the rotation arm butts against the movable member when the rotating body rotates in the second rotating direction, and thereby causes the moveable member to move.

3. The opening and closing device according to claim 2, wherein the movable member is arranged to move away from the tip-end section of the rotation arm when the rotating body is positioned at the second position and to the front of the tip-end section in the moving direction when rotation occurs in the second direction of the rotating body such that the tip-end section of the rotation arm butts against the movable member when the rotating body rotates in the second rotating direction by only a prescribed angle from the second position towards the first position.

4. The opening and closing device according to claim 2, wherein the movable member is formed in a rod shape, the longitudinal direction thereof is arranged in the same direction as the moving direction of the tip-end section of the rotation arm, and the tip-end section of the rotation arm butts against one end of the movable member in the longitudinal direction.

5. The opening and closing device according to claim 4, wherein the tip-end section of the rotation arm, the movable member, and the damper body are arranged so as to be aligned in nearly a row in the movement direction of the tip-end section of the rotation arm.

* * * * *